US007448117B1

(12) United States Patent
Sauder et al.

(10) Patent No.: US 7,448,117 B1
(45) Date of Patent: Nov. 11, 2008

(54) CORNER TRIM ASSEMBLY

(75) Inventors: Myrl D. Sauder, Archbold, OH (US); Ronald D. Roth, Wauseon, OH (US)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 11/879,368

(22) Filed: Jul. 17, 2007

(51) Int. Cl.
*A61G 17/00* (2006.01)

(52) U.S. Cl. ..... 27/10; 52/288.1

(58) Field of Classification Search ..... 27/10; D99/13; 52/287.1, 288.1
See application file for complete search history.

(56) References Cited

U.S. PATENT DOCUMENTS

| | | | | |
|---|---|---|---|---|
| 101,172 | A * | 3/1870 | Smith et al. | 296/30 |
| 202,470 | A | 4/1878 | Richey | |
| 216,749 | A | 6/1879 | McAlister | |
| 461,730 | A | 10/1891 | Beers | |
| 1,193,723 | A | 8/1916 | Skahen | |
| 1,610,781 | A | 12/1926 | Hollins | |
| 2,213,506 | A | 9/1940 | Thoresen | |
| 2,450,091 | A | 9/1948 | Kendall | |
| 2,594,580 | A | 4/1952 | Paul | |
| 3,490,114 | A | 1/1970 | Connelly | |
| 3,835,509 | A | 9/1974 | Esterdahl | |
| 3,879,818 | A | 4/1975 | Rowland | |
| 3,924,309 | A | 12/1975 | Andrus, Jr. et al. | |
| 3,962,761 | A | 6/1976 | Boughner | |
| 4,195,394 | A | 4/1980 | Semon | |
| 4,327,536 | A | 5/1982 | Ascher | |
| 4,571,790 | A | 2/1986 | James, III | |
| 4,584,856 | A | 4/1986 | Petersdorff et al. | |
| 4,930,197 | A | 6/1990 | McClive | |
| 5,120,168 | A | 6/1992 | Padula | |
| 5,499,886 | A | 3/1996 | Short et al. | |
| 5,570,493 | A | 11/1996 | Gulick | |
| 5,588,788 | A | 12/1996 | Dominguez | |
| 5,611,124 | A | 3/1997 | Biondo et al. | |
| 5,709,016 | A | 1/1998 | Gulick et al. | |
| D390,321 | S | 2/1998 | Maple et al. | |
| 5,727,291 | A | 3/1998 | Biondo et al. | |
| 5,765,268 | A | 6/1998 | MacKirdy | |
| 5,813,100 | A | 9/1998 | Mackirdy | |
| 5,875,529 | A | 3/1999 | Ollier | |
| D411,461 | S | 6/1999 | Schultz | |
| 5,960,524 | A | 10/1999 | Darby et al. | |
| 5,974,640 | A | 11/1999 | Vosahlik et al. | |
| 5,985,399 | A | 11/1999 | Tambussi | |
| D417,540 | S | 12/1999 | Agee et al. | |
| D418,961 | S | 1/2000 | Biondo et al. | |

(Continued)

*Primary Examiner*—William L. Miller
(74) *Attorney, Agent, or Firm*—MacMillan, Sobanski & Todd, LLC

(57) ABSTRACT

A corner trim assembly includes a first panel having a first panel first end. A second panel has a second panel first end. The second panel first end is attached to the first panel first end. A first trim screw is attached to the first panel. A second trim screw is attached to the second panel. The first and second trim screws each have a screw rim. Each screw rim is spaced apart from the first and second panels. A first trim piece and a second trim piece each have a channel. The channels of the first and second trim pieces are engaged with the screw rims of the first and second trim screws to hold the first and second trim pieces against the first and second panels, respectively.

15 Claims, 6 Drawing Sheets

U.S. PATENT DOCUMENTS 6,018,853 A 2/2000 Chen et al.
6,094,789 A 8/2000 Hankel et al.
6,138,334 A 10/2000 Tambussi
6,138,335 A * 10/2000 Drawbaugh et al. ..... 27/10
D433,585 S 11/2000 Bowers et al.
6,151,762 A 11/2000 Cox
6,179,515 B1 1/2001 Grieser et al.
6,238,327 B1 5/2001 Tambussi
6,301,758 B1 10/2001 Biondo et al.
6,317,942 B1 11/2001 Hankel et al.
6,317,945 B1 11/2001 Laphan et al.
6,543,103 B1 * 4/2003 Robert ..... 27/10
6,557,222 B2 5/2003 Groemminger et al.
6,591,466 B1 7/2003 Acton et al.
6,601,355 B2 * 8/2003 Kreitz et al. ..... 52/287.1
6,615,464 B2 9/2003 Tambussi
6,691,385 B2 2/2004 Bell et al.
6,745,442 B2 6/2004 Biondo et al.
6,883,212 B2 4/2005 Groemminger et al.
6,928,706 B2 8/2005 Acton et al.
7,069,627 B2 7/2006 Cunningham et al.
7,210,204 B2 5/2007 Groemminger et al.
7,260,872 B2 * 8/2007 Schultz ..... 27/10
7,340,810 B2 * 3/2008 Acton et al. ..... 27/10
2001/0049868 A1 12/2001 Tambussi
2004/0158959 A1 8/2004 Bell et al.
2005/0005410 A1 1/2005 Biondo et al.
2005/0183252 A1 8/2005 Groemminger et al.
2005/0268441 A1 12/2005 Acton et al.

* cited by examiner

CORNER TRIM ASSEMBLY

TECHNICAL FIELD

The invention relates generally to caskets. More specifically, the invention is directed to a trim assembly for a corner of the casket.

BACKGROUND OF THE INVENTION

Caskets are used for the interment of the bodies of deceased persons. Before interment, the body of the deceased is typically displayed for the benefit of loved ones at a funeral. Caskets are often offered in a wide variety of styles and finishes from which a customer can select to suit the customer's taste. Some caskets incorporate decorative or ornamental corner pieces that accent the style or finish of the casket.

Caskets are typically constructed of opposing side panels connected to opposing end panels. The side panels and the end panels may be made of solid wood or a wood composite having a veneered exterior. Each corner of the casket is formed by the intersection of a side panel and an end panel. The exterior of each corner should be finished in a manner consistent with the style and finish of the overall casket. The exterior of each corner should be finished with an ease of assembly and in a cost effective assembly. The invention provides such a corner trim assembly.

SUMMARY OF THE INVENTION

A corner trim assembly includes a first panel having a first panel first end.

A second panel has a second panel first end. The second panel first end is attached to the first panel first end.

A first trim screw is attached to the first panel. A second trim screw is attached to the second panel. The first and second trim screws each have a screw rim. Each screw rim is spaced apart from the first and second panels.

A first trim piece and a second trim piece each have a channel. The channels of the first and second trim pieces are engaged with the screw rims of the first and second trim screws to hold the first and second trim pieces against the first and second panels, respectively.

DETAILED DESCRIPTION OF THE INVENTION

Figure 1:
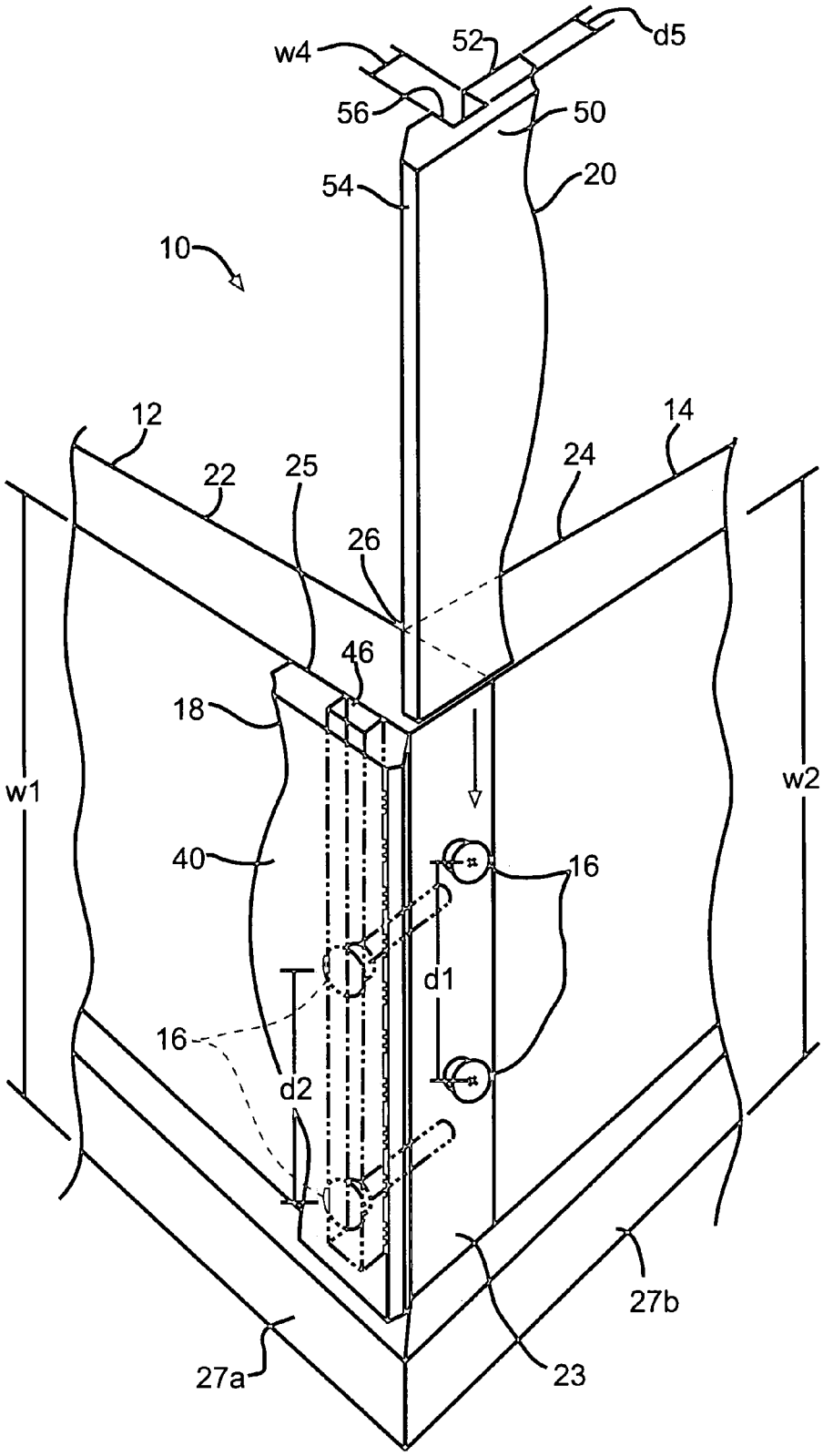
FIG. 1 is a perspective view, partially in cross section, of a corner trim assembly according to the invention.
Figure 2:
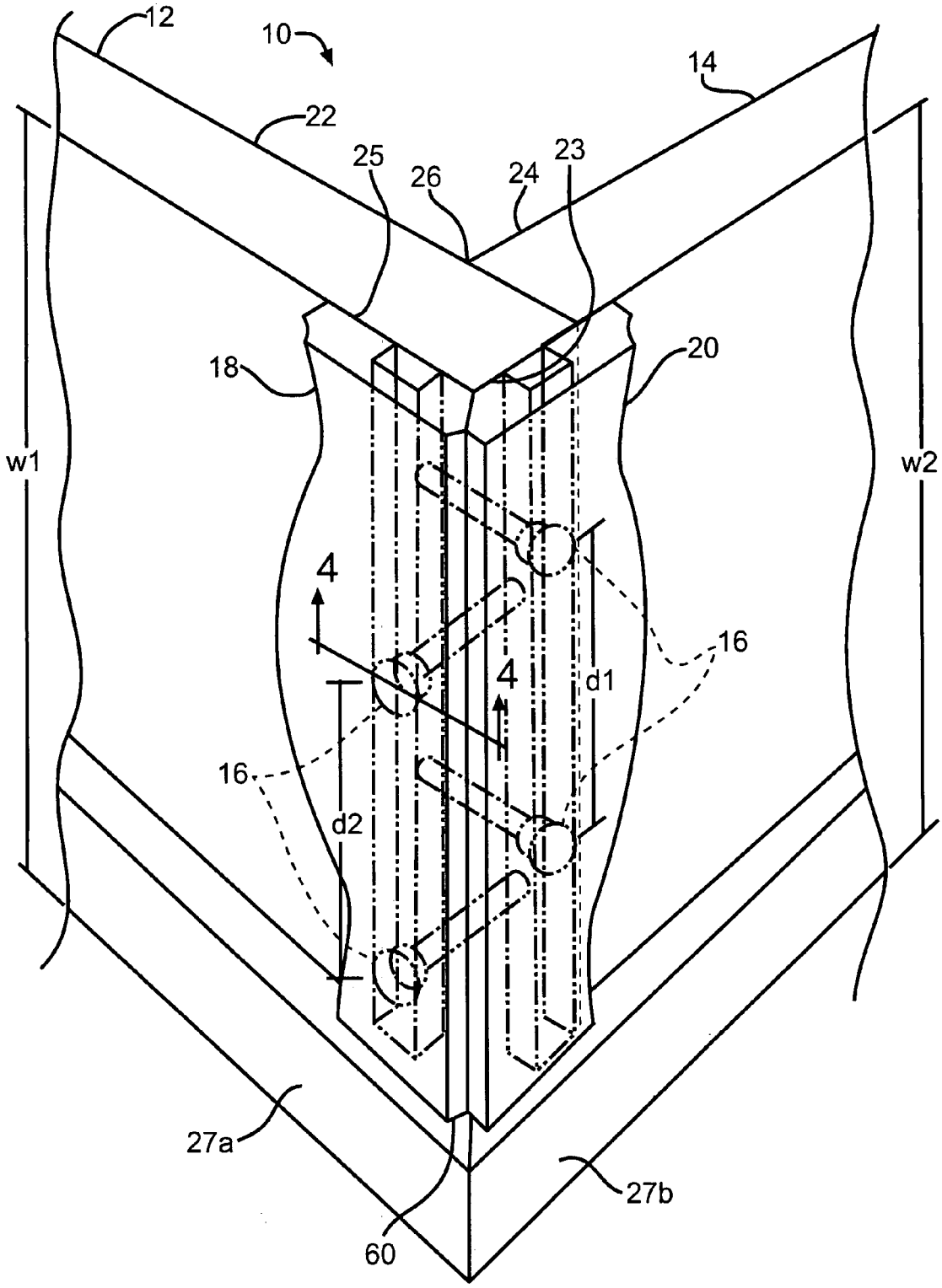
FIG. 2 is a perspective view, partially in cross section, of the corner trim assembly of FIG. 1.

Referring to FIGS. 1 and 2, a corner trim assembly is indicated generally at 10. The corner trim assembly 10 includes a first panel 12, a second panel 14, one or more trim screws 16, a left trim piece 18 and a right trim piece 20.

As shown in FIGS. 1 and 2, the first panel 12 has a first panel first end 22 and the second panel 14 has a second panel first end 24. The first panel first end 22 and the second panel first end 24 are joined to form a joint assembly 26. In the embodiment shown in FIGS. 1 and 2, the joint assembly 26 is a butt joint. In another embodiment, the joint assembly 26 can be other type of joints, such as for example a dovetail joint, a half lap joint, a finger joint, or a miter joint.

In one embodiment of the corner trim assembly 10, the first panel 12 and the second panel 14, are made of particleboard having laminated surfaces and laminated edges. In another embodiment, the first panel 12 and the second panel 14 can be made of other materials.

As shown in FIGS. 1 and 2, the first panel 12 has a first panel width w1 and the second panel 14 has a second panel width w2. In the illustrated embodiment, the first panel width w1 and the second panel width w2 are the same. In another embodiment, the first panel width w1 may be shorter or longer than the second panel width w2.

As shown in FIGS. 1 and 2, the first panel 12 has a first panel edge 23 and a first panel first end surface 25.

As shown in FIGS. 1 and 2, the joint assembly 26 can include optional molding 27*a* and 27*b*. The molding, 27*a* and 27*b*, is configured to present a finished-furniture appearance to the corner trim assembly 10. As shown in FIGS. 1 and 2, the molding, 27*a* and 27*b*, is a crown-style molding. Alternatively, the molding, 27*a* and 27*b*, can be any molding structure, such as dentil molding, sufficient to present a finished-furniture appearance to the corner trim assembly 10.

As shown in FIGS. 1 and 2, one or more trim screws 16 are spaced apart along the first panel edge 23 and along the first panel first end surface 25. The trim screws 16 disposed on the first panel edge 23 are spaced apart a distance d1 and the trim screws 16 disposed on the first panel first end surface 25 are spaced apart a distance d2. In the illustrated embodiment, the distance d1 and the distance d2 are the each about six inches. In another embodiment the distance d1 and the distance d2 can be more or less than six inches. In yet another embodiment, the distance d1 and the distance d2 can be different lengths.

Figure 3:
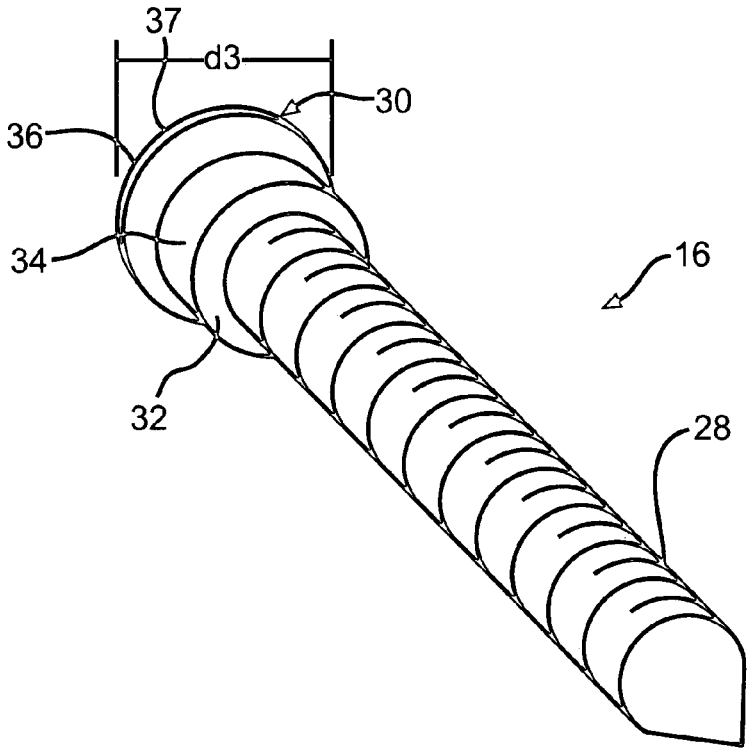
FIG. 3 is a perspective view of a trim screw of the corner trim assembly of FIG. 1.
Figure 4:
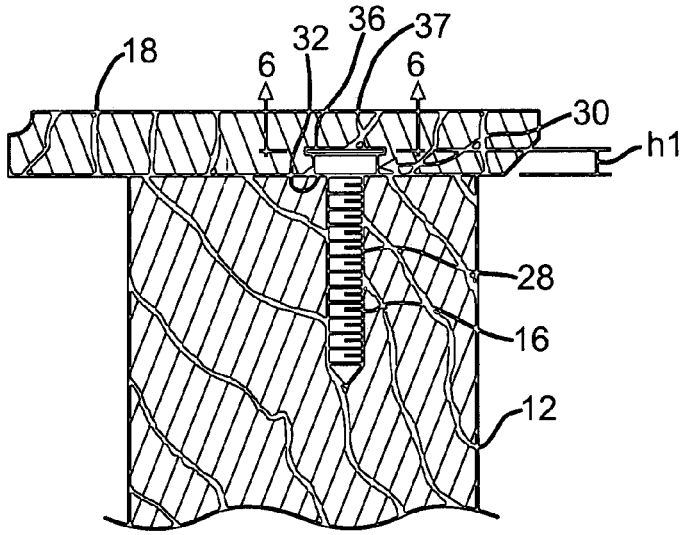
FIG. 4 is a side view taken along line 4-4 of FIG. 2.

Referring now to FIGS. 3 and 4, the trim screw 16 includes a threaded shaft 28 connected to a screw head 30. In the illustrated embodiment, the threaded shaft 28 has a #8 diameter and a #15 type A thread. In another embodiment, the threaded shaft can have a different diameter and a different thread type.

The screw head 30 includes a screw shoulder 32, a screw neck 34, and a screw rim 36. In general, the trim screws 16 are driven into the joint assembly 26 such that each screw shoulder 32 seats against the first panel edge 23 or the first panel first end surface 25. When seated against the first panel edge 23 or the first panel first end surface 25, the screw neck 34 of the trim screw 16 raises the screw rim 36 to a height h1. In the illustrated embodiment, the height h1 is approximately 3.5 mm. In another embodiment, the height h1 can be more than or less than 3.5 mm.

As shown in FIGS. 3 and 4, the screw rim 36 extends circumferentially from the screw neck 34. The screw rim 36 has a diameter d3. In the illustrated embodiment, the diameter d3 of the screw rim 36 is about 9.5 mm. In another embodiment, the screw rim 36 can be more or less than 9.5 mm. As will be explained later in more detail, the screw rim 36 engages the left trim piece 18 and the right trim piece 20 and holds the left and right trim pieces, 18 and 20, in position.

The screw rim 36 includes a screw rim top 37. The screw rim top 37 includes a tool aperture (not shown). The tool aperture is configured for engagement with a tool for driving the trim screw 16 into the joint assembly 26. In the illustrated embodiment, the tool aperture is a phillips style slot. In another embodiment, the tool aperture can be another style slot, such as for example a hex head or a torx head, sufficient to drive the trim screw 16 into the joint assembly 26.

Figure 5:
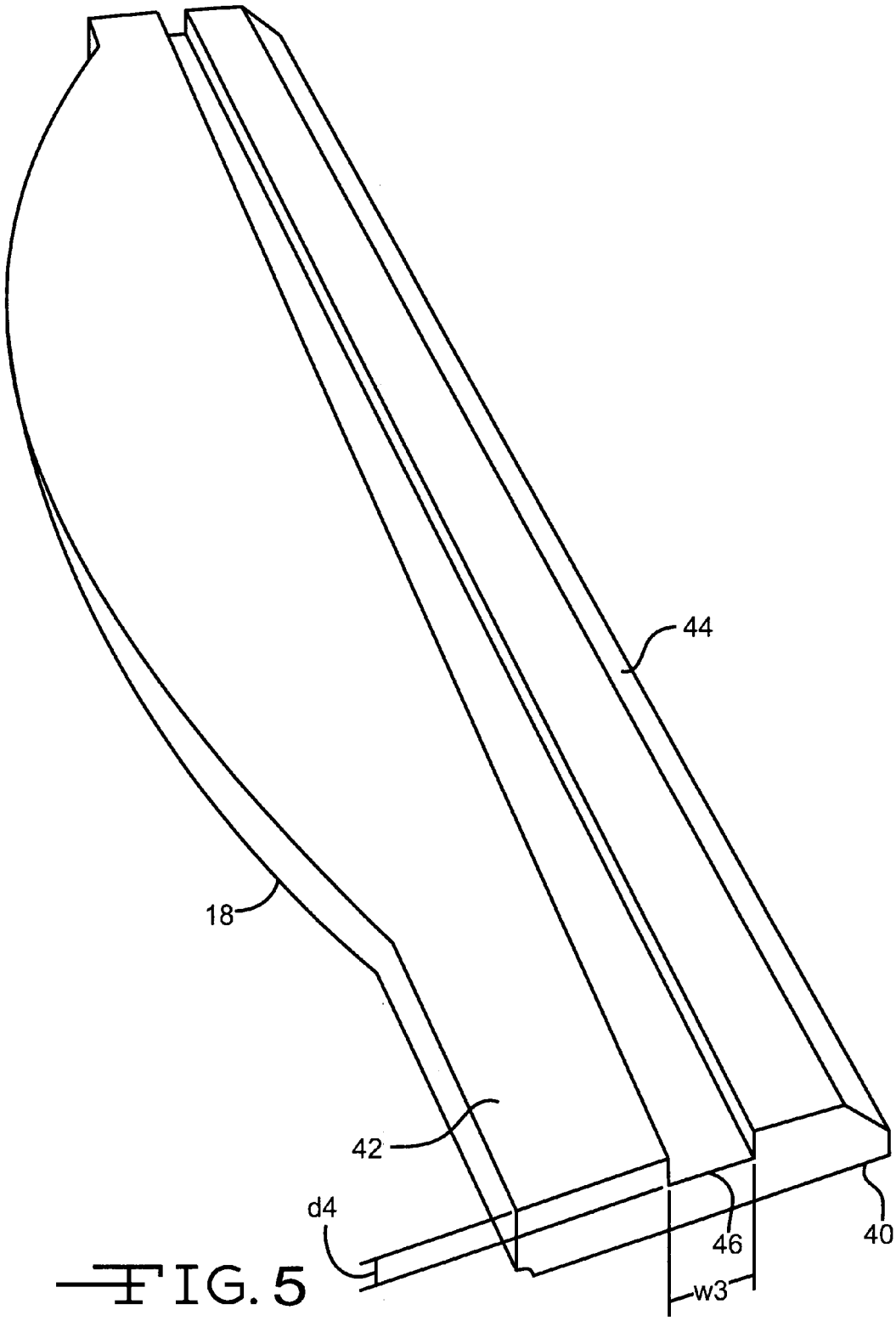
FIG. 5 is a perspective view of a trim piece of the corner trim assembly of FIG. 1.

As shown in FIGS. 1, 2, and 5, the left trim piece 18 includes a left trim piece top surface 40, a left trim piece bottom surface 42, a left trim piece joint edge 44 and a left trim piece channel 46. In the illustrated embodiment, the left trim piece top surface 40 is has a furniture quality finish. In another embodiment, the left trim piece top surface 40 can have another finish, such as for example a painted finish.

As shown in FIG. 5, the left trim piece channel 46 extends the length of the left trim piece 18 and is substantially parallel to the left trim piece joint edge 44. The left trim piece channel 46 has depth d4 and a width w3. In the illustrated embodiment, the depth d4 is about 4.0 mm and the width w3 is about 8.3 mm.

Similarly as shown in FIG. 1, the right trim piece 20 includes a right trim piece top surface 50, a right trim piece bottom surface 52, a right trim piece joint edge 54 and a right trim piece channel 56. The right trim piece channel 56 extends the length of the right trim piece 20 and substantially parallel to the right trim piece joint edge 54. The right trim piece channel 46 has depth d5 and a width w4. In the illustrated embodiment, the depth d5 is about 4.0 mm and the width w4 is about 8.3 mm.

As shown in FIG. 2, the left trim piece joint edge 44 and the right trim piece joint edge 54 join to form a trim corner 60. In the illustrated embodiment, the trim corner 60 has a beveled cross-sectional shape. In another embodiment, the trim corner 60 can have another cross-sectional shape.

Figure 6:
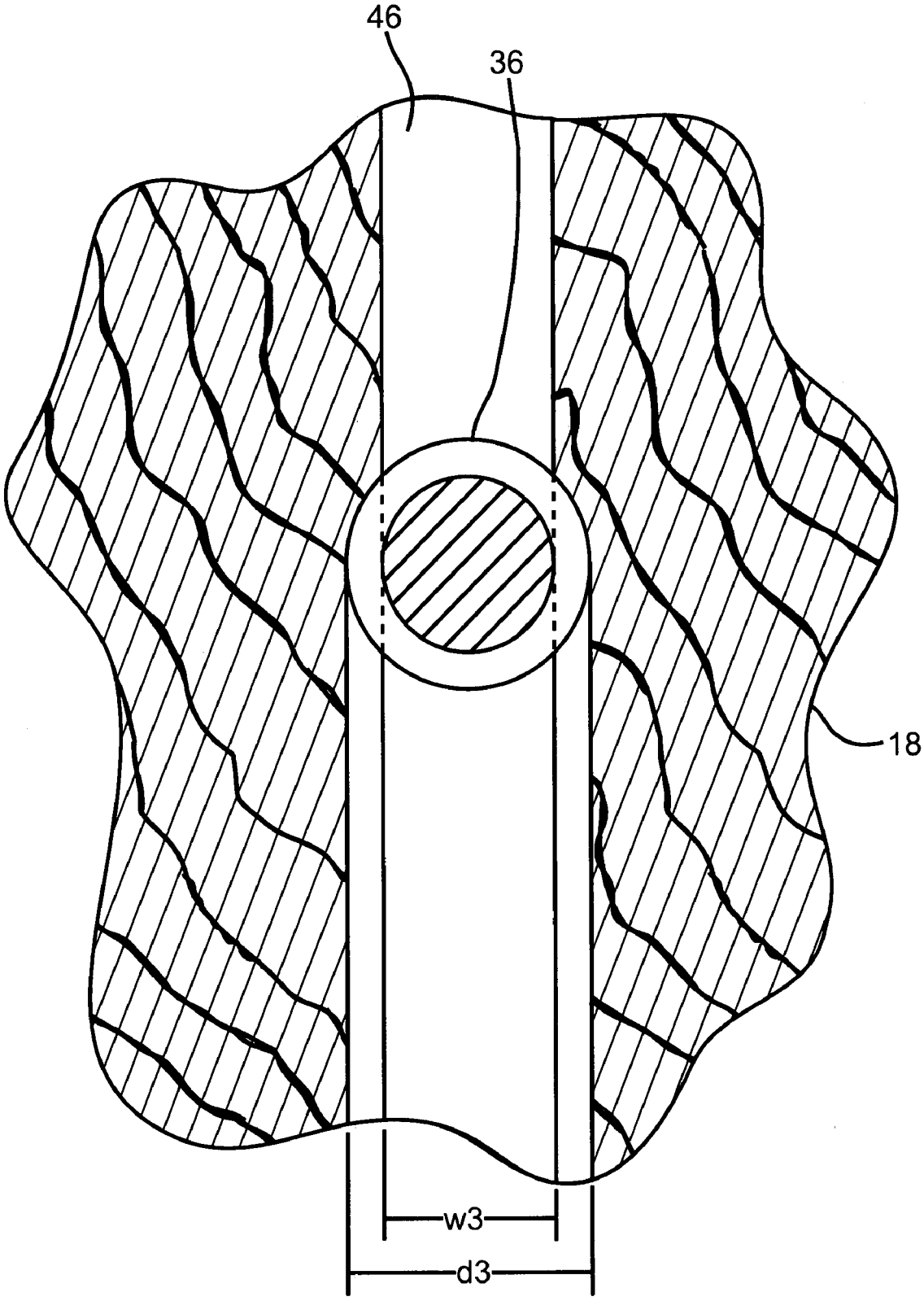
FIG. 6 is a plan view of a trim piece channel engaged with the trim screw of the corner trim assembly of FIG. 1.

As shown in FIGS. 1, 2 and 6, the corner trim assembly 10 is assembled by driving one or more trim screws 16 into the joint assembly 26 such that each screw shoulder 32 seats against the first panel first end surface 25. The left trim piece channel 46 of the left trim piece 18 is vertically positioned above the trim screws 16 such that the left trim piece bottom surface 42 contacts the first panel first end surface 25. The left trim piece 18 is slid downward such that the screw rims 36 of the trim screws 16 engage the left trim piece channel 46. The width d3 of the screw rim 36 of the trim screws 16 is larger than the width w3 of the left trim piece channel 46 resulting in an interference fit between the trim screws 16 and the left trim piece 18. In the illustrated embodiment, the width d3 of the screw rims 36 is about 1-2 mm larger than the width w3 of the left trim piece channel 46. In another embodiment the width d3 of the screw rims 36 can be larger than the width w3 of the left trim piece channel 46 by more than 1-2 mm. As the left trim piece 18 is slid downward into final position, the interference fit between the screw rims 36 of the trim screws 16 and the left trim piece channel 46 of the left trim piece 18 firmly holds the left trim piece 18 against the first panel 12. The right trim piece 20 is installed in a similar manner. The installed right and left trim pieces, 18 and 20, form the trim corner 60 and the corner trim assembly 10.

Figure 7:
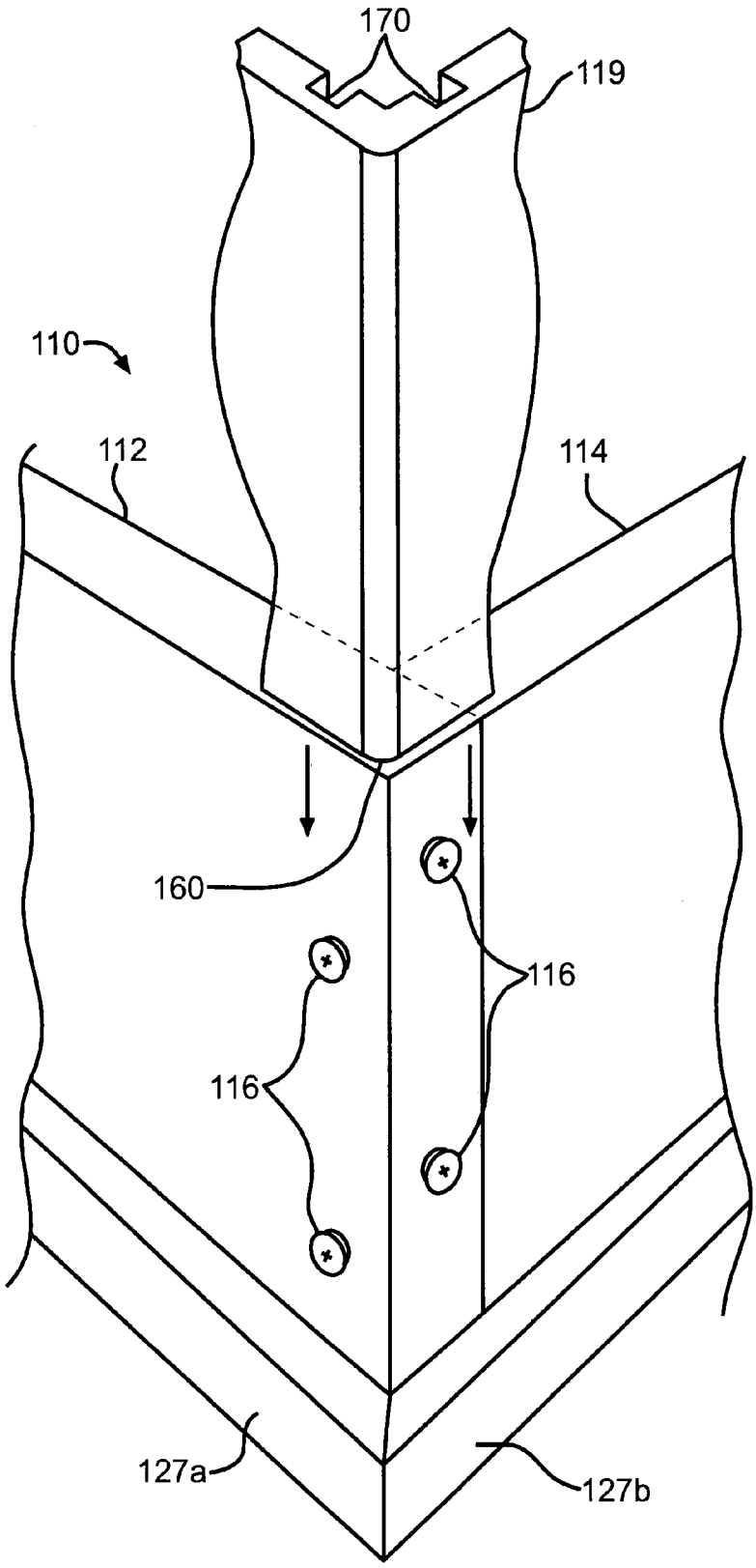
FIG. 7 is a second embodiment of the corner trim assembly illustrating a single trim piece.

In another embodiment as shown in FIG. 7, the corner trim assembly 110 includes first panel 112, a second panel 114, one or more trim screws 116, optional molding 127*a* and 127*b*, and a trim piece 119. In this embodiment, the trim piece 119 is a single trim piece that forms the trim corner 160. The trim piece 119 is installed by aligning a plurality of trim channels 170 with trim screws 116. The trim piece 119 is urged downward such that the trim screws 116 form an interference fit with the plurality of trim channels 170. Accordingly the trim piece 119 is held against the first and second panels, 112 and 114, in its final position.

While the above described corner trim assembly 10 has been directed to a casket, it should be understood that the corner trim assembly 10 can be applied to any structure or assembly, such as for example assembled furniture or ready-to-assemble furniture, having a corner.

Further, while the above described corner trim assembly 10 is directed to application on an outside corner, it should be understood that the corner trim assembly 10 can be applied to an inside corner.

While the invention as been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

We claim:

1. A corner trim assembly comprising:

a first panel having a first panel first end;

a second panel having a second panel first end, the second panel first end attached to the first panel first end;

a first trim screw attached to the first panel, a second trim screw attached to the second panel, the first and second trim screws each having a screw rim, each screw rim spaced apart from the first and second panels; and a first trim piece and a second trim piece each having a channel, the channels of the first and second trim pieces being directly engaged with the screw rims of the first and second trim screws to hold the first and second trim pieces against the first and second panels, respectively.

2. The corner trim assembly of claim 1, wherein the first panel first end and the second panel first end are attached to each other in a butt joint.

3. The corner trim assembly of claim 1, wherein the first panel and the second panel are made of particle board.

4. The corner trim assembly of claim 1, wherein the first panel has a first panel width and the second panel has a second panel width, wherein the first panel width is the same as the second panel width.

5. The corner trim assembly of claim 1, wherein molding is attached to the first and second panels.

6. The corner trim assembly of claim 1, wherein the trim screws have a #8-15 Type A thread.

7. The corner trim assembly of claim 1, wherein each trim screw includes a screw shoulder, wherein the screw shoulder seats against the first and second panels.

8. The corner trim assembly of claim 1, wherein each trim screw includes a screw neck, the screw neck raising the screw rim a distance of about 3.5 mm from the first or second panel.

9. The corner trim assembly of claim 1, wherein the screw rim has a diameter of about 9.5 mm.

10. The corner trim assembly of claim 1, wherein the channel of the trim pieces has a square cross-sectional shape.

11. The corner trim assembly of claim 10, wherein the channel has a depth and a width, wherein the depth is about 4.0 mm and the width is about 8.3 mm.

12. The corner trim assembly of claim 1, wherein each of the first and second trim pieces has a trim piece joint edge, wherein the trim piece joint edges form a trim corner.

13. The corner trim assembly of claim 12, wherein the trim corner has a beveled cross-sectional shape.

14. The corner trim assembly of claim 1, wherein the trim pieces engage the screw rims by sliding the trim pieces downward over the screw rims.

15. The corner trim assembly of claim 1, wherein the screw rims have a diameter and the channel has a width, wherein the diameter of the screw rims is larger than the width of the channel by about 1-2 mm.

* * * * *